United States Patent [19]

Northrup, Jr.

[11] 3,977,467

[45] Aug. 31, 1976

[54] AIR CONDITIONING MODULE

[76] Inventor: Leonard L. Northrup, Jr., 4312 Westway, Dallas, Tex. 75205

[22] Filed: Sept. 3, 1974

[21] Appl. No.: 502,647

Related U.S. Application Data

[62] Division of Ser. No. 361,797, May 18, 1973, abandoned.

[52] U.S. Cl. ..... 165/65; 62/286; 62/326; 165/76; 165/137; 165/122; 219/366; 219/370

[51] Int. Cl.[2] ..... H05B 1/00; F25B 29/00; F24H 3/04

[58] Field of Search ..... 219/366–371, 219/374–376, 361; 165/121, 122, 48, 59, 65, 137, 76; 417/423; 415/98, 201, 219 C; 98/114; 62/326, 286, 298

[56] References Cited

UNITED STATES PATENTS

| | | | |
|---|---|---|---|
| 1,128,475 | 2/1915 | Maxfield | 415/98 |
| 2,282,373 | 5/1942 | Minkler et al. | 165/137 X |
| 2,361,007 | 10/1944 | Buchanan | 417/423 |
| 2,441,726 | 5/1948 | Smith | 219/370 X |
| 3,061,706 | 10/1962 | Lundbom | 165/122 X |
| 3,073,296 | 1/1963 | Hollingsworth et al. | 165/122 X |
| 3,089,315 | 5/1963 | Brandt | 62/326 |
| 3,098,145 | 7/1963 | Raymond | 165/48 X |
| 3,174,541 | 3/1965 | Brandt et al. | 165/137 X |
| 3,236,061 | 2/1966 | Wells | 62/285 |
| 3,299,660 | 1/1967 | Sullivan | 165/137 UX |
| 3,628,590 | 12/1971 | Knebusch | 62/286 X |
| 3,678,993 | 7/1972 | Pierce | 62/326 |
| 3,726,611 | 4/1973 | Astrom | 417/423 R |
| 3,775,029 | 11/1973 | Ranz | 415/98 X |

*Primary Examiner*—A. Bartis
*Attorney, Agent, or Firm*—H. Mathews Garland

[57] ABSTRACT

Air conditioning apparatus which includes an air blower-heater module useful independently and also in a unit having cooling coils providing means for heating, cooling, and filtering air in air conditioning systems for enclosures. The module has a squirrel cage type centrifugal blower in a housing having scroll shaped baffling with an electric heater at the outlet. The baffling is shaped to minimize turbulence; the heater is mounted within a heat shield spaced within the baffling to reduce housing temperatures; and the blower motor is mounted exterior of the blower chamber for maximum air input. A preferred application of the module is in a cube shaped fancoil unit having a square cooling coil assembly which may be installed at various orientations to provide for bottom drainage with a variety of directions of air intake and discharge. In the cube unit using the module, the air intake and discharge paths are perpendicular to each other. The cube unit may be mounted for horizontal intake and horizontal discharge from either side, or vertical discharge, either upwardly or downwardly.

13 Claims, 14 Drawing Figures

AIR CONDITIONING MODULE

This is a divisional application of application Ser. No. 361,797 entitled AIR-CONDITIONING DEVICE filed May 18, 1973 by Leonard L. Northrup, Jr. and now abandoned.

This invention relates to air conditioning apparatus and more particularly relates to module type blower units for heating and/or cooling and heating air.

A wide variety of apparatus for conditioning air by filtering and heating and cooling the air is available to satisfy many different operating conditions. Generally, however, there is substantial difference in design of the units for satisfying varying requirements. For example, furnaces are available for horizontal-flow, up-flow and down-flow. Each of these furnaces is specific to the particular flow pattern for which it is designed and it generally is not adaptable to other air flow patterns. Such furnaces also are generally useable with cooling coil assemblies which are mounted in appropriate locations depending upon the particular character of the furnace blower unit. Down-flow and up-flow furnaces normally are mounted in closets which require substantial floor space and usually also additional space for air circulation and access for maintenance. The available horizontal type furnace units which are usually used in attics require space around them for maintenance and usually necessitate access stairways or doors to the attic with floored working area around the equipment for maintenance purposes. Generally, the available furnace units have a straight through flow pattern which requires additional ducts exterior of the unit, particularly in instances where it is desired to turn the air flow 90 degrees. Such ducts require extra building space around the unit. With such available apparatus, the costs involved to the manufacturers, the distributors, installers and the ultimate consumer are important considerations. The manufacturing and inventory costs are material factors for the producers of such equipment. The inventory of many varieties of types and sizes is also a major factor in costs for distributors. For the consumer, installation costs along, particularly, with the space requirements of conventional heating and cooling systems are becoming more significant because of increased labor and material costs. Further, the matter of maintenance is significant with the accessibility of some present units often requiring more time of the serviceman. Other facts affecting some available units are increased costs for insulation and some net final increase in costs due to the need for higher capacity of equipment because of reduced air flow rates in some available systems. Noise is objectionable in some present units.

It is a particularly important object of the invention to provide new and improved air conditioning apparatus.

It is another object of the invention to provide a new and improved module or "heart" in the form of a basic blower-heater unit which may be combined in many ways with other components to produce a variety of types of heating and air conditioning systems.

It is another object of the invention to provide air conditioning apparatus which requires a minimum of insulation.

It is another object of the invention to provide a module type air conditioning unit which has an improved air flow rate characteristics.

It is another object of the invention to provide a basic air flow and heating unit which may be approved by such organizations as Underwriters Laboratories, Inc. thereby providing a basic component about which a variety of apparatus designs may be assembled without requiring further approval for each and every particular application.

It is a further object of the invention to provide a unit for air conditioning air by filtering, heating and cooling the air in the form of a cube-shaped cabinet having cooling coils which may be installed in a variety of orientations to provide a plurality of desired air flow patterns with a basic set of equipment.

It is another object of the invention to provide an air conditioning and heating component wherein all power and other controls to the system are mounted in panels accessible through one service door.

It is another object of the invention to provide a basic fully integrated unit for heating and cooling air which is readily adaptable to up-flow, down-flow and horizontal flow with no noticeable affect on the operation of the unit in the different positions or orientations.

In accordance with one aspect of the invention, there is provided a module or heart for an air conditioning system which includes a centrifugal blower mounted in a scroll-shaped housing having a full open discharge passage in which an electrical resistence heating element is mounted in spaced heat shielded relationship. Intake openings are provided in opposite sides of the module cabinet for air supply to the blower. The blower motor is mounted outwardly of the blower chamber for maximum smooth in-flow of air around the motor. The electrical resistence heater is mounted within a rectangular heat shield spaced inwardly of the discharge opening walls permitting a layer of non-heated air to flow around the heater element for maintaining a cool cabinet walls for the module. In accordance with another aspect of the invention, a cube fan-coil unit is provided incorporating the heart within a cube-shaped cabinet including a square cooling coil assembly which may be mounted in any one of four positions at 90° intervals in the intake opening of the cabinet to permit a variety of orientations for the cube without re-design. All unit controls, electrical connections and the like are mounted on panels along one side of the heart and accessible through a single service door into the cube cabinet to simplify repair and replacement of components. The intake and discharge openings in the cabinet are disposed in a 90° relationship so that air is always discharged at 90° to the line of air intake. The cube is adapted to be assembled for horizontal intake and any one of horizontal, vertical upward, or vertical downward discharge.

These and further objects and advantages of the invention will be apparent from reading the following detailed description of preferred embodiments of the invention taken in conjunction with the accompanying drawings wherein.

Referring to FIGS. 1–5, a blower-heater module or "heart" 20 embodying the invention includes a centrifugal blower 21 and an electrical resistence heating unit 22 housed in a cabinet 23. The heart is a basic module which serves as a source of either ambient or heated air and which may be adapted to a number of different air conditioning system configurations including, particularly, the cube fan-coil unit of FIGS. 6–14.

Figure 5:
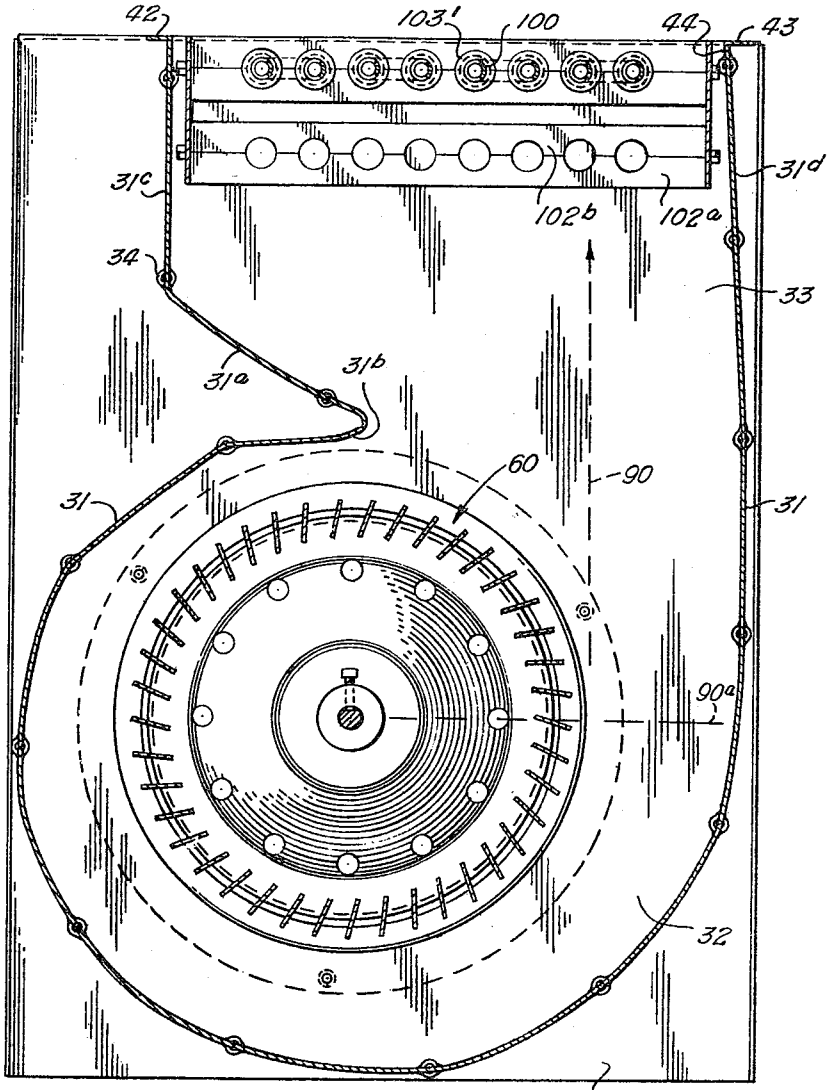
FIG. 5 is a view in section of the module taken along the line 5—5 of FIG. 3.
Figure 4:
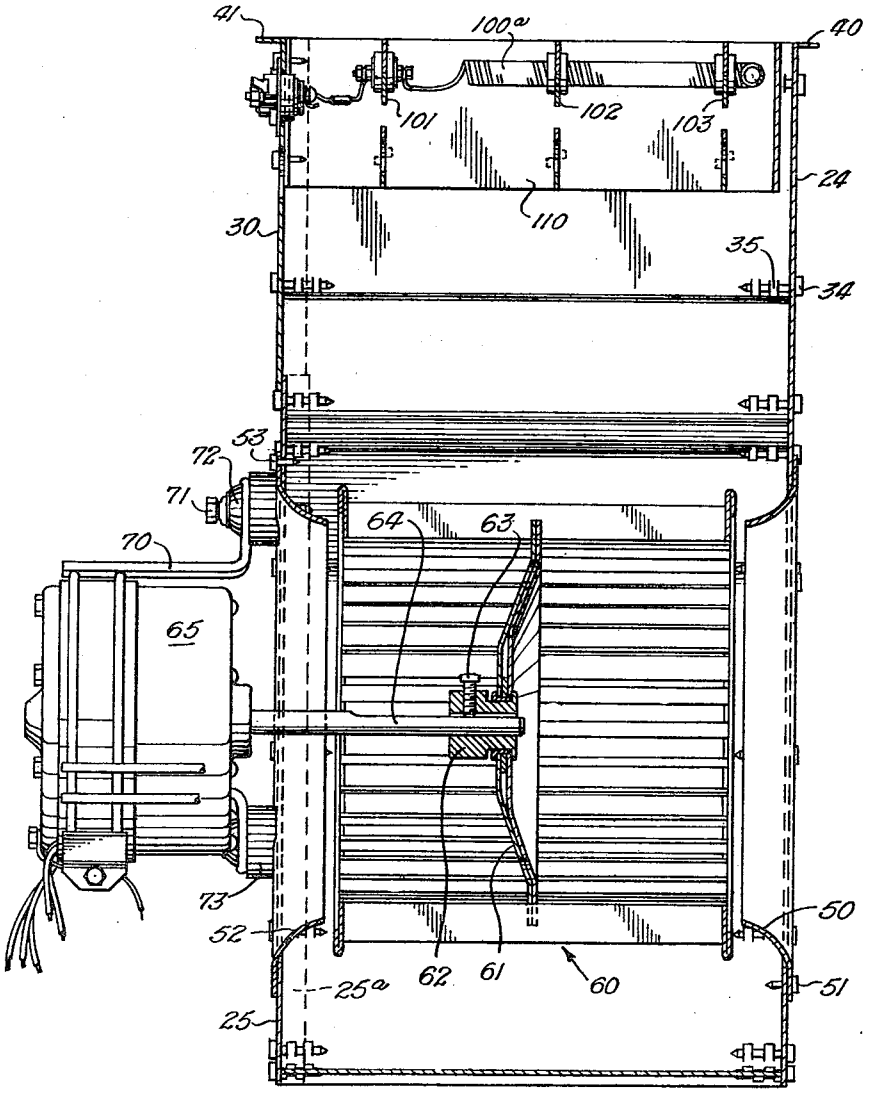
FIG. 4 is an enlarged view in section taken along the line 4—4 of FIG. 2.

The cabinet 23 of the heart 20 comprises a first side panel 24, a second opposite lower side panel 25, and upper side panel 30 which also serves as a heater mounting board and control panel. The side panels are joined together to form the cabinet by a scroll-shaped blower housing member 31 which, as shown in FIG. 5, defines an air chamber 32 in which the blower is operative and a discharge flow passage 33 enclosing and leading to the heater unit 22. The sides are connected with the housing member 31 by a plurality of sheet metal screws 34 secured through the sides into the housing member in a suitable conventional manner. As seen in FIG. 4, spaced short securing strips 35 are formed near the edges of the housing member 31 to receive the sheet metal screws 34. This is a standard technique for connecting one panel with the edge of a perpendicular adjoining metal panel. For strengthing purposes, the upper edge of the side panel 24 is flanged at 40, while, similarly, the upper endge of the upper side panel 30 is flanged at 41. The upper end edges of the housing member 31, also, are flanged at 42 and 43. The panel flanges 40, 41, 42 and 43 define a reinforced discharge opening 44 for the flow passage 33 of the blower housing. Additionally, for strengthing purposes, the vertical edges of the side panels are all turned inwardly providing vertical strengthening flanges to such panels as evident in FIG. 3. Such edge flanges along the side panel 24 are denoted by the reference numerals 24*a*, and, similarly, the edge flanges of the side panel 30 are designated by the reference numerals 30*a* while the vertical edge flanges of the lower side of panel 25 are seen only in broken lines in FIG. 4 designated by the reference numeral 25*a*. The opposite ends of the blower housing are provided with circular openings defined by an annular flange member 50 secured by screws 51 into a circular opening of the side panel 24 and an annular flange member 52 secured into a circular opening of the side panel 25 by sheet metal screws 53. As seen in FIG. 4, the flange members 50 and 52 have inwardly turned flanges which are arcuate in cross section to permit smooth air flow into the blower housing. The flange members 50 and 52 define the two intake openings into the opposite ends of the blower housing and blower fan.

Figure 1:
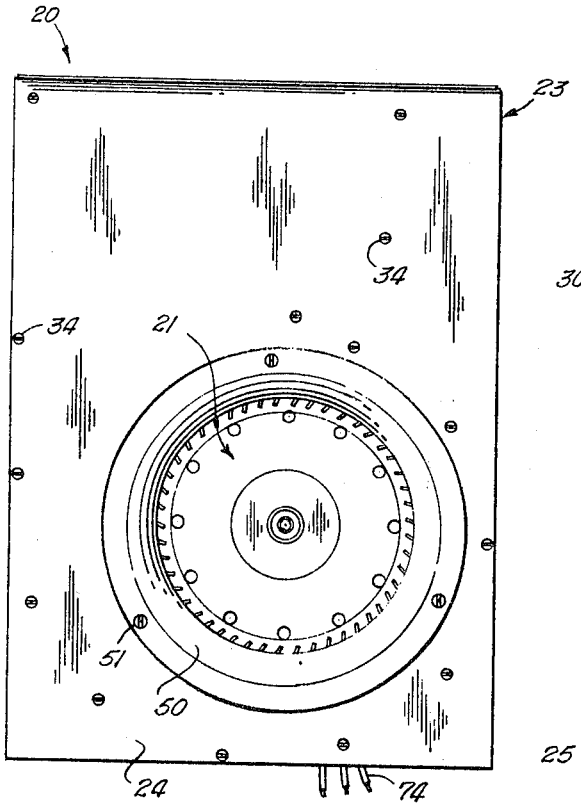
FIG. 1 is a side view in elevation of a blower-heater module constructed in accordance with the invention.
Figure 2:
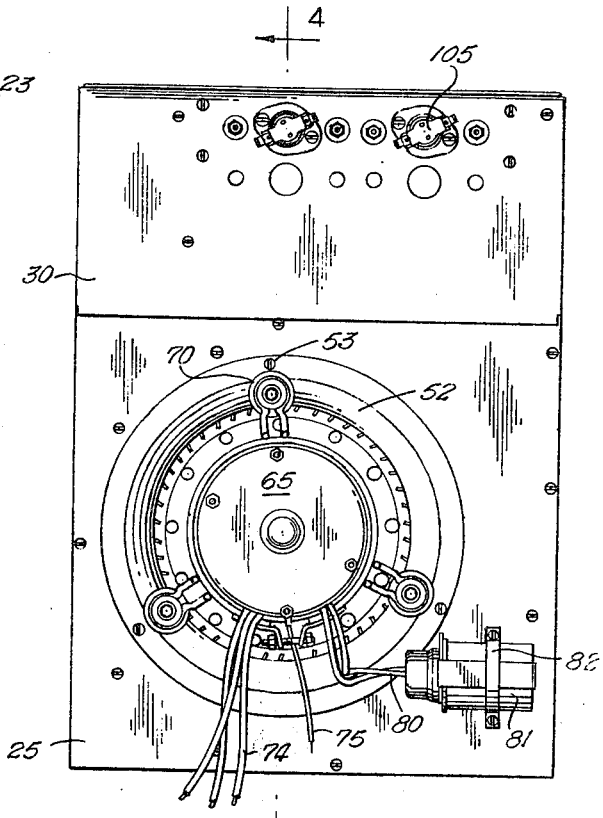
FIG. 2 is a view in elevation of the module taken from the opposite side from that of FIG. 1.
Figure 3:
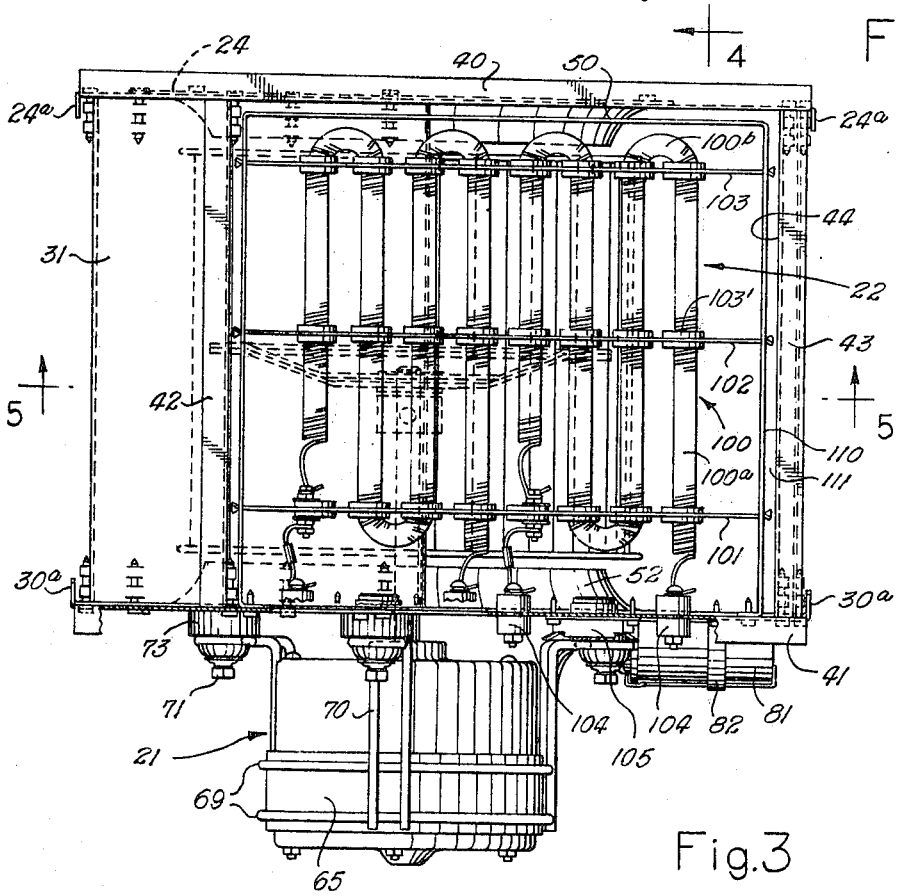
FIG. 3 is an enlarged top view in elevation of the module shown in FIGS. 1 and 2.

The blower unit 21 includes a squirrel cage type centrifugal fan 60 eccentrically supported within the blower housing chamber 32 with the opposite open ends of the fan spaced inwardly and substantially coincident with the openings defined by the annular flange members 50 and 52. The fan includes a central circular mounting plate 61 secured on a fitting 62 held by a set screw 63 on a shaft 64 of a blower motor 65. The blower motor is held by wire rings 69 connected to circumferentially spaced L-shaped wire brackets 70 secured by bolts 71 which extend to the flange member 52 and the lower side panel 25. The bolts pass through rubber or plastic mounting members 72 and 73 which provide a shock resistent support for the blower fan and motor. The mounting members 72 and 73 also serve as spacers to hold the motor outwardly of the chamber opening defined by the flanged member 52. As evident in FIGS. 3 and 4, the motor is spaced substantially outwardly of the inlet opening through the member 52 to permit maximum flow of air inwardly into the blower chamber 32 around the motor with minimum turbulence. As seen in FIGS. 2 and 4, a plurality of leads 74, 75, and 80 are connected with the motor for power and control purposes. Leads 80 extend from a motor control unit 81 of a conventional design mounted by a bracket 82 on the outside face of the side panel 25. The sizing of the opening through which the annular flange members 52 is mounted in the side panel 25 is slightly larger than the diameter of the blower fan 60 so that with removal of the flanged member 52 from the side panel, the blower fan may be adjusted or replaced.

The shapes of the blower housing 32 and the discharge passage 33 are defined by the curved panel member 31 to provide maximum air flow with minimum turbulence. As seen in FIG. 5, the discharge portion 33 is closed along a return panel portion 31*a* connecting with what shall be referred to as the "cut-off portion" 31*b*, whereas in most conventional fan housing and discharge passage designs, the space toward the discharge passage downstream from the cut-off portion 31*b* is normally open without a closure panel such as shown by 31*a*. This closure of the space behind the cut-off minimizes turbulence that is normally inherent to the conventional design blower housing and discharge. The discharge opening 33 is considered to be enlarged or "opened" as compared with conventional blower discharge passages. As seen in FIG. 5, the panel portions 31*c* and 31*d* defining the discharge opening 33 are essentially perpendicular to the base or bottom of the module in the particular orientation of the module shown in the drawings. Further, these panels 31*c* and 31*b* are substantially parallel to a tangent line drawn to the blower fan 60 at a point in a plane 90*a* passing through the shaft 64 parallel with the base of the module as seen in FIG. 5. Such a tangent line is represented by the pointed broken line designated by the reference numeral 90. By spacing the panel portion 31*d* from the blower and sloping it from the intersection with the line 90*a* toward the line 90 and placing the panel portion 31*c* essentially parallel with the line 90, a discharge opening 33 is defined which directs a maximum volume of air from the blower along essentially straight lines of flow which are perpendicular to the plane of the coils in the heater element 22. This design has been found to increase air flow as much as seven to eight percent which is a significant improvement in the conventional blower-heater designs. Thus, the plane of the heater element is perpendicular to a tangent line drawn from the heater element plane to the fan which is represented by the line 90 and the discharge passage walls are essentially parallel to the tangent line and may be perpendicular to the base end of the module.

An especially important feature of the invention is the mounting of the electrical resistence heater unit 22 within the discharge passage 33 of the heart 20. The heater unit is supported from and removable with the side panel 30 for quick, easy servicing of the module. The heater unit 22 includes a plurality of electrical resistence heating coils 100 formed in straight sections 100*a* and curved sections 100*b*. In the particular configuration of the heating unit illustrated, two such coils arranged in a single layer are shown. Each coil is a spiral wire in a serpentine configuration through three parallel spaced support panels 101, 102 and 103. As seen in FIG. 5, each of the support panels comprises a pair of identical mounting strips such as the strips 102*a* and 102*b*, each of which has semicircular spaced recesses which fit together to form a series of longitudinal spaced holes for annular ceramic insulators 103' for supporting the heating coil in electrically insulated relationship from the panels. At the end of the heater unit adjacent to the cabinet side panel 30, the end connection wires of the heating coils are secured through insulated taps 104 for connection of electrical power to the heater unit coils. Suitable heating coils controls and electrical connections, not shown, are mounted on the side panel 30 when the heart or module is in service in an air conditioning system. One such control is a heat sensing device 105 used in connection with the operation of the coils. The coil support panels 101, 102 and 103 are fixed at opposite ends into a three-sided rectangular heat shield 110 which is secured at opposite ends to the side panel 30 mounted in spaced relation within the discharge passage 33 of the module defining an air space 111 extending across each end and along one side of the unit opposite the side panel 30. The air space 111 permits flow of a layer of air within the fan discharge passage to maintain the casing walls of the heart sufficiently cool that special insulation is unnecessary. As noted in FIGS. 4 and 5, the height of the heat shield 110 exceeds the height of two layers of heating coils. With the heater unit 22 supported from the panel 30, the heater unit is removable with the panel for servicing without disturbing any other components of the module. The particular configuration of the blower discharge passage in relation to the blower and the arrangement of the heater unit provides uniform heating of air over the entire cross-sectional area of the discharge passage 33 to prevent stratification of air as by having hot and cold streams which represent problems with uniform temperature distribution. Additionally, the heater coils 100 may be operated at a high efficiency level in the black heat range rather than being required to operate at a glowing temperature which shortens the life of the heating system and additionally makes cool uniform temperature operations of the module more difficult.

The heart or module 20 may be used in a number of applications where air can be introduced into the sides of the unit and discharged along a perpendicular direction to provide heated air under sufficient pressure to distribute the air to one or more rooms to be conditioned. The heart is readily adaptable to systems which include cooling coils for reducing the temperatures of the air in the enclosures to which it is delivered. An especially desirable feature of the heart is the fact that it can be serviced from one side of the unit as shown in FIG. 2. All controls, electrical connections, and the like are available on the side panels 25 and 30. The blower motor, fan, and related structure are readily removed from the side panel 25. The heater is removable for repair and replacement by simply taking out the upper side panel 30. Thus, access to the heart is not required except at the one side defined by the panels 25 and 30. It is thereby possible to effectively close off the top, two ends, bottom, and opposite side insofar as access is concerned for service purposes.

Another principal feature of the invention is the cube fan-coil unit 120 illustrated in FIGS. 6–14, which utilizes the module or heart 20 of the invention. The cube unit 120 comprises a heart 20, a cooling coil unit 121, and may include a filter assembly 122 housed within a cube-shaped cabinet 123. The cabinet is of suitable conventional metal construction having internally insulated metal panels covering those sides which are solid, appropriate openings for intake and discharge air, and a hinged access door 124 of substantially the same rectangular shape and size as the combined side panels 25 and 30 of the module or heart 20. In the particular form of the cube shown in FIGS. 6 and 7, the cabinet has a bottom 125, one side 130 opposite the air intake side, a top 131, a side 132 which includes the access door 124, and a solid opposite side 133. The top 131 of the cabinet includes a rectangular opening, not shown, which is the same shape and size as the discharge air passage 33 at the top of the heart as shown in FIGS. 4 and 5. The access door 124 is mounted along a left vertical edge in the orientation of the cube shown in FIG. 6 on a vertical shaft or hinge pin 134 which permits the door to swing outwardly for maximum access into the cabinet to the side panels of the heart for servicing the cube unit. The access door has internal insulation 124*a*, while similarly the bottom has internal insulation 125*a*. The side of the cabinet opposite the closed side 130, which is the air intake side has a full square opening 140 which is properly sized to receive the cooling coil assembly 121. The cooling coil assembly is a suitable conventional refrigerant coil having horizontal refrigerant tube portions 141 intertwined through vertical fins 142 which serve to distribute the cooling effect over the full face of the coil for cooling air passing perpendicular to the plane of the coil between the fins and the tubes. Refrigerant inlet and outlet lines 143 and 144, respectively, supply refrigerant to the cooling coil assembly. A drain pan 145 is secured around the lower ends of the fins to collect condensate which flows from the coil assembly. The condensate is drained from the pan 145 in a line 150 connected into one side of the drain pan.

The cube shape of the unit 120 permits the cooling coil assembly 121 to be installed at any one of four positions at 90° intervals around the opening 140 into the cube unit. The cooling coil assembly must always be installed to position the drain pan 145 and line 150 at the bottom of the unit as the condensate is controlled by gravity flow to drain the water removed from the air as the air is drawn into the unit past the cooling coils. With such four positions available for the cooling coil assembly in the cube shaped cabinet, the cube unit 120 may be positioned for air discharge upwardly, downwardly, or out either side of the cabinet depending upon the orientation of the cube. A suitable standard square air filter 160 is supported in a housing 161 over the outside surface of the cooling coil assembly 121 to filter air entering the cube unit. The filter is removed and inserted through a vertical narrow panel door 162 held by screws 163. The square air filter housing is preferably formed by extension portions of the bottom, top, and sides of the cube unit cabinet as indicated in FIG. 6.

Figure 6:
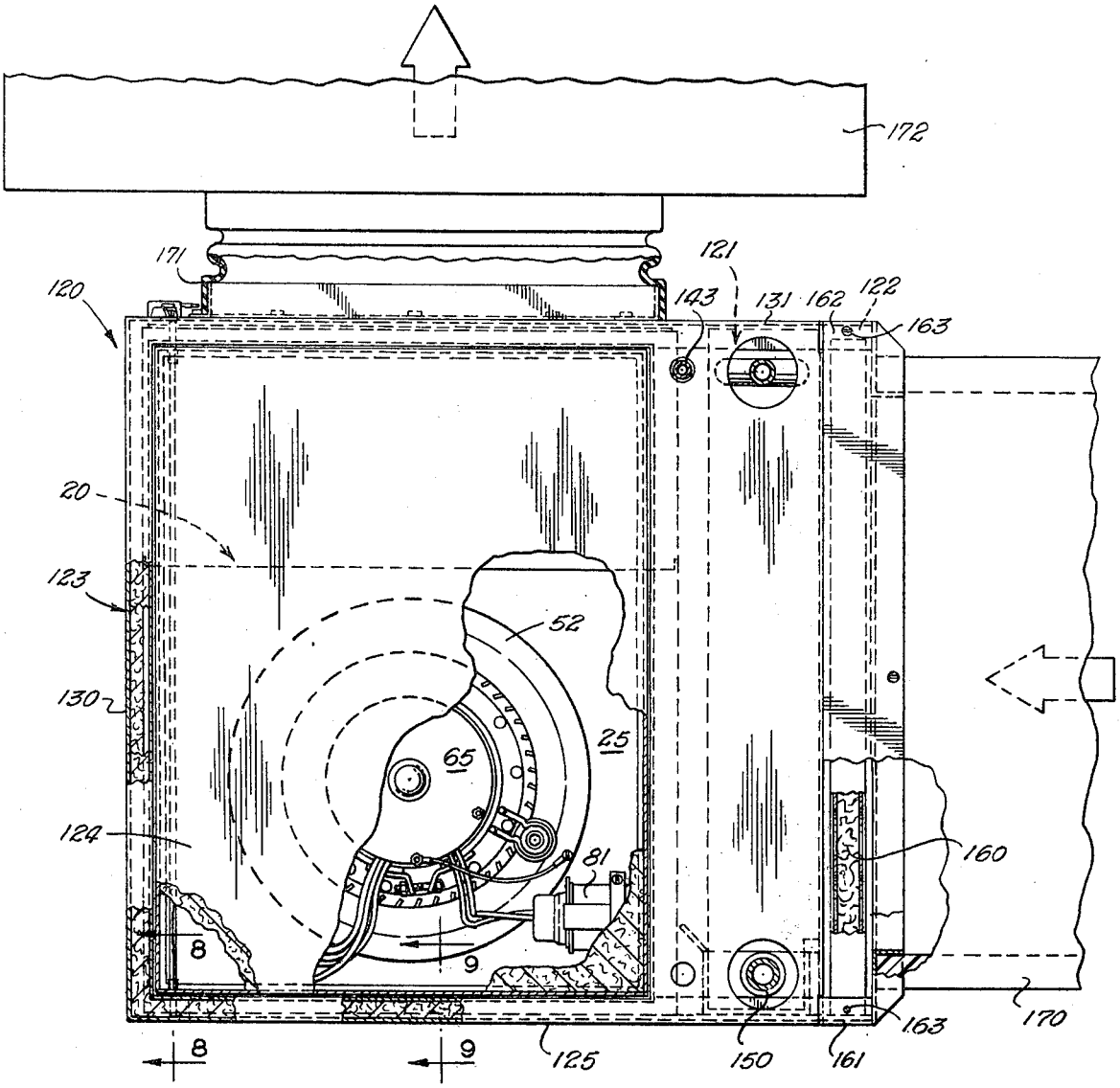
FIG. 6 is a top planned view partially broken away of a cube fan-coil unit constructed in accordance with the invention.
Figure 8:
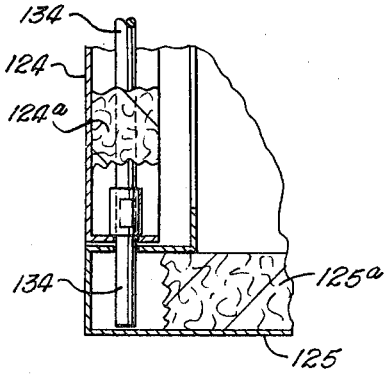
FIG. 8 is a fragmentary view in section along the line 8—8 of FIG. 6.
Figure 9:
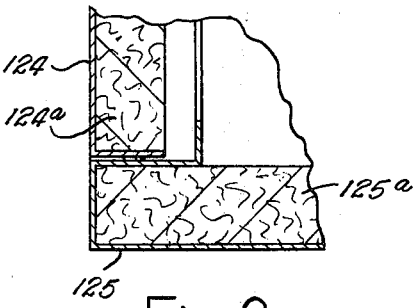
FIG. 9 is a fragmentary view in section along the line 9—9 of FIG. 6.
Figure 7:
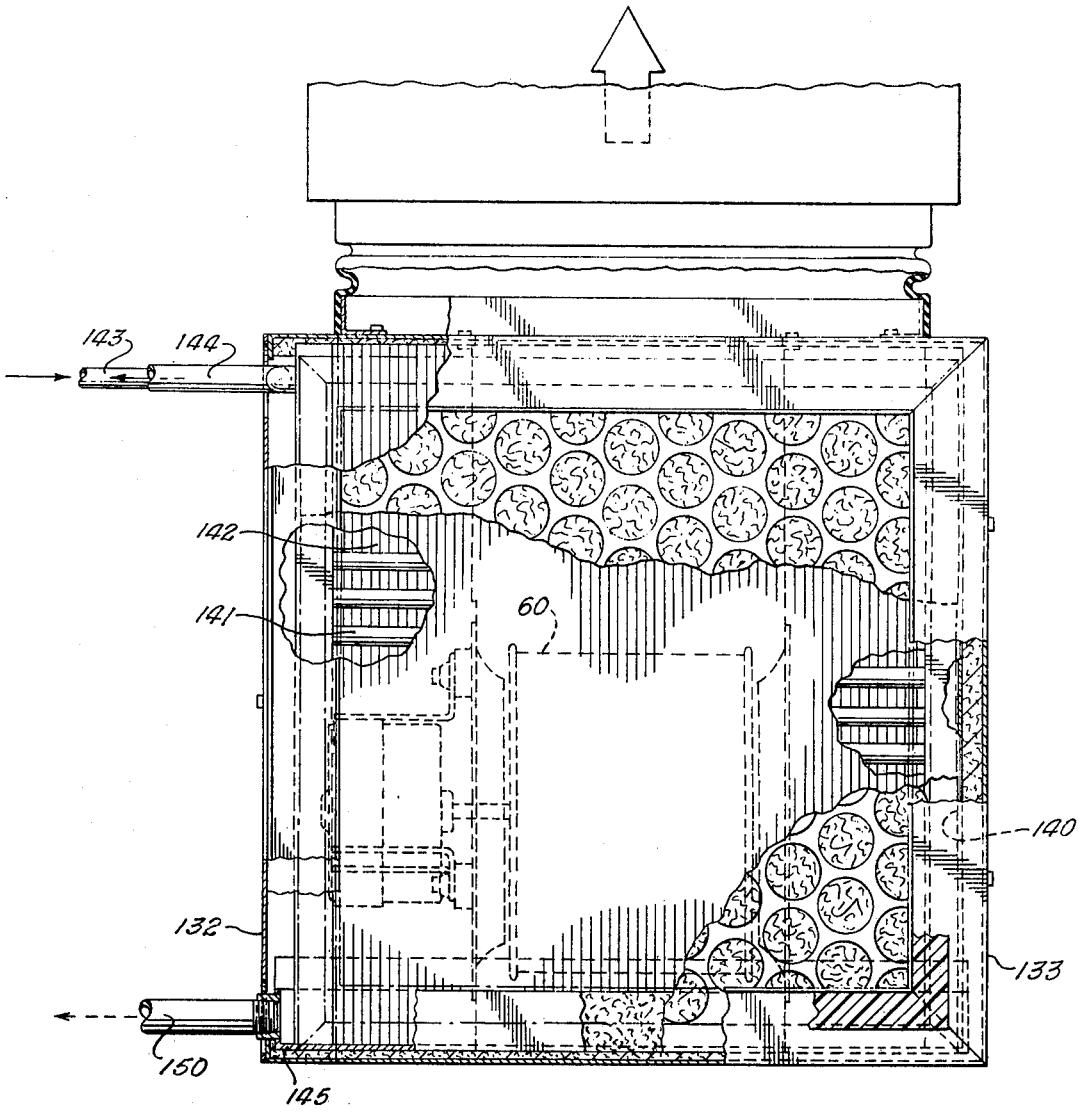
FIG. 7 is a side view in elevation of the cube fan-coil unit shown in FIG. 6 as seen from the coil side with the duct removed.

In FIGS. 6 and 7 an air inlet duct 170 is shown connected into the air inlet side of the cube unit 120 for flow of supply or return air to the unit from the particular enclosure being air conditioned by the unit. An air discharge fitting 171 is connected to the outside of the unit over the opening in the unit cabinet leading to the air discharge passage 33 directing the air from the fan over the heating coils. The air discharge fitting connects with an air supply duct 172 leading to the particular enclosure being air conditioned by the unit. With this particular arrangement, the circulating air is filtered, cooled, and dehumidified prior to entry into the module or heart 20 of the unit and the discharge across the heating coils. This sequence of air treatment protects the operating mechanism of the unit and the heating coils from both the dirt and the moisture picked up by the air as it is circulated through the enclosure being air conditioned.

Figure 11:
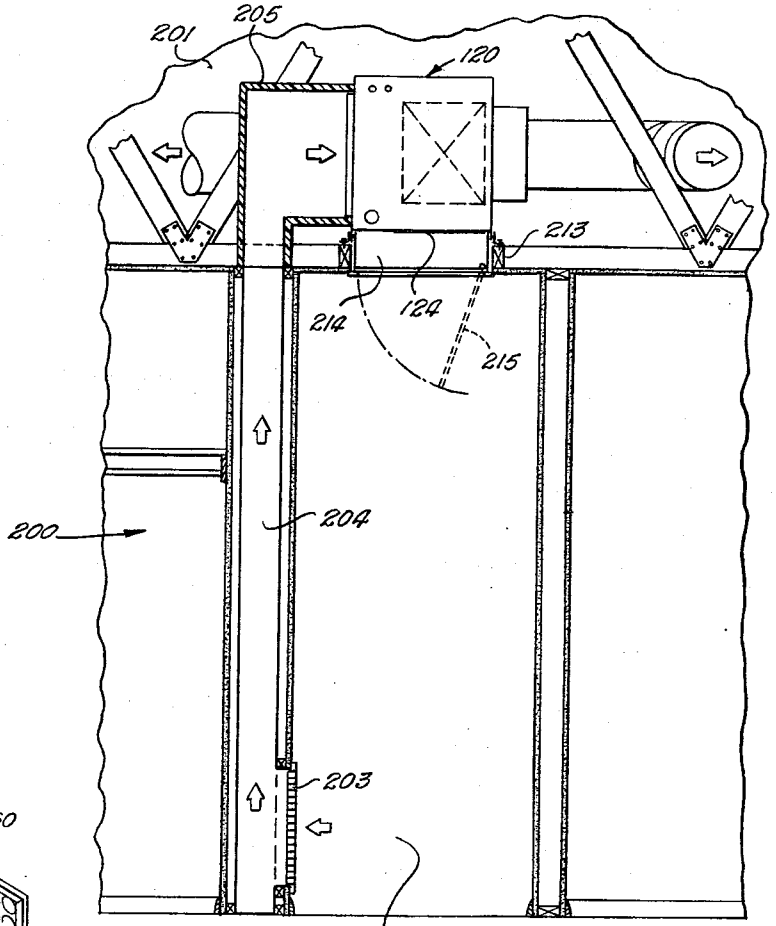
FIG. 11 is a fragmentary side view in elevation and section showing the system of FIG. 10.
Figure 10:
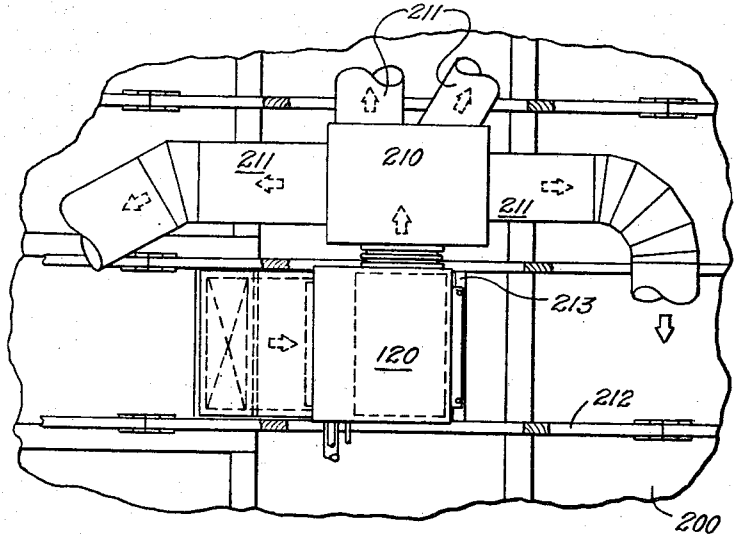
FIG. 10 is a top fragmentary plan view showing a portion of an air conditioning system for an enclosure using the cube fan-coil unit of FIGS. 6–9.

A typical installation of the cube fan-coil unit 120 is illustrated in FIGS. 10 and 11 in which the unit is shown positioned for cooling a structure generally referred to be the reference numeral 200. The cube unit is mounted in the attic space 201 for pulling air from the air conditioned area 202 through a return air grill 203, upwardly within a wall section through a return air duct 204 into a 90° turn duct fitting 205. The air enters the cube 120 horizontally and is discharged horizontally at a 90° angle into a discharge plenum 210 which connects with a plurality of air supply ducts 211 leading back through supply grills, not shown, to the air conditioned space 202. The shape and size of the cube unit conveniently permits it to be mounted between ceiling joists 212 on a pair of headers 213 without cutting or otherwise impairing or weakening the joists. The pair of headers connected between the ceiling joists on opposite sides of the unit form a service sleeve 214 over which a hinged access door 215 is connected for servicing the unit. The cube unit is oriented to position the access door 124 to the side panels 25 and 30 of the heart downwardly so that it and the filter door 162 may be opened in the service sleeve when the access door 215 is opened. It will be evident that the only height required in the attic space is that of the dimension of the cube unit since this installation uses a side discharge. No service area need necessarily be reserved around the unit within the attic because all access to the unit for filter replacement, fan servicing, and heating coil servicing is through the service sleeve 214. The refrigerant lines 143 and 144 are connected with a remote compressor-condenser unit, not shown, which generally is located outside on a roof or at ground level, while the condensate drain line 150 is connected into a sanitary sewer line, not shown, leading to the structure. The various electric and control leads are, of course, connected with suitable thermostat and a supply of electricity, not shown.

Figure 13:
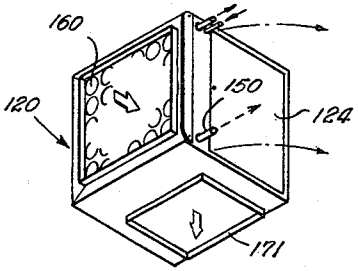
FIG. 13 is a perspective view of a further form of the cube fan-coil unit.
Figure 14:
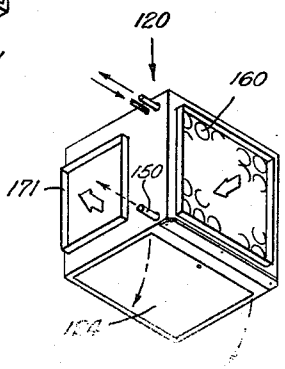
FIG. 14 is a perspective view of still another form of the cube fan-coil unit.
Figure 12:
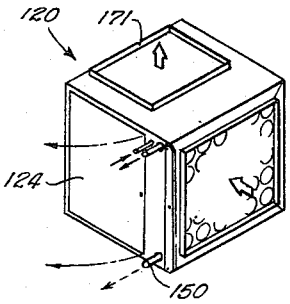
FIG. 12 is a perspective view of another form of the cube fan-coil unit.

FIGS. 12, 13 and 14 illustrate the versatility and universal application of the cube fan-coil unit 120. FIG. 12 shows the unit assembled for horizontal air inlet and vertical air discharge with the access door 124 oriented as shown in FIGS. 6 and 7. It will be noted that the cooling coil is supplied with refrigerant and the drain line exits from the side with the access door. Utilizing the same module or heart unit 20 and the same cooling coil, the cube fan-coil unit is assembled as illustrated in FIG. 13 for horizontal air inlet and vertical downward air discharge. It will be apparent that this configuration is obtained by turning the cube unit upside down from the position of FIG. 12 and installing the cooling coil assembly with the drain line at the bottom which also involves inverting the cooling coil assembly from the orientation of FIG. 12 so that the air discharge outlet and the drain line are both at the bottom of the unit. The configuration of FIGS. 12 and 13 are achieved with the same component parts by simply orienting the parts differently when the unit is assembled. It is to be noted that the access door in the configuration of both FIGS. 12 and 13 is horizontal. Another arrangement of the cube fan-coil unit for horizontal air discharge is illustrated in FIG. 14. It will be apparent that the configuration of FIG. 14 is obtained by revolving the cube unit 90° counter-clockwise and rotating the cooling coil assembly 90° in a clockwise direction as compared to the arrangement of FIG. 12. It will be recognized that when it is stated that the cooling coil assembly is revolved, it is not intended to suggest that there is mechanism within the cube unit permitting the physical rotation of the cooling coil assembly while connected in the unit, but rather the geometrical configuration and the mechanical structure of the unit permits it to be disassembled and reassembled with the proper orientation between the various components of the unit to achieve the desired different directions of air discharge and access door location and the like. It will be noticed that in the arrangement of FIG. 14 the module or heart 20 will be lying on a side rather than in a vertical position as in the arrangements of FIGS. 12 and 13. Obviously, the heating coils of the module are facing upwardly in the form of the unit in FIG. 12 while facing downwardly in FIG. 13. It will be apparent that in the configurations of FIGS. 12 and 13 refrigerant and drain line access holes are provided in the side panels in which the access door 124 is secured, while such access holes for the refrigerant and drain lines are in the panel including the air discharge opening in the form of the unit in FIG. 14. Flexibility to accomodate these changes is readily obtained by the use of small knock-out discs or providing open holes in the various side panels as required for the refrigerant and drain lines to further minimize the part changes required for the several configurations available. In addition to the arrangements shown in FIGS. 13 and 14, the cube fan-coil unit may also be assembled to provide the following air flow and service access: horizontal flow - side service; up flow - side service, with the service being from the opposite side from that shown in FIG. 12; down flow - side service, with service from the opposite side from that shown in FIG. 13; horizontal flow - bottom service, with air discharge from the opposite side from that shown in FIG. 14; and horizontal flow - side service.

It will be seen that once the cube fan-coil unit 120 is installed in the attic of a structure easy access to the unit for servicing purposes may be had through a service door without the requirement of a serviceman getting into the attic to work. Such service includes changing of the filter, changing of the blower and blower motor, and working any of the connections and controls along the side panels 25 and 30 of the heart of the unit. It will be obvious that should a leak develop in the refrigerant tubes in the coil assembly of the unit that some disassembly of the unit will be required for access to the coils. This, of course, is not normal and would be out of the line of regular service requirements. The configuration of the unit including the fact that the air makes a 90° turn passing through the unit contributes to minimizing sound transmission from the unit into the air conditioned space served by the unit. The particular arrangement of the cube unit with respect to sound transmission provides for sound waves to always strike sound absorbent surfaces rather than being projected directly into any of the enclosures served by the unit. With respect to the module or heart 20 alone, it is capable in commercial production of being made in a minimum number of sizes, each of which may be approved by organizations such as Underwriters Laboratories, Inc. with the subsequent assembly from such heart of a much larger number of air conditioning systems. For example, as a practical matter, it has been found that three different sizes of heart units may make it possible to produce as many as 40 different configurations of combined heart and cooling coil systems, such, particularly, as the type disclosed herein as the cube unit. Thus, the manufacturer can design a minimum number of the heart units and from the develop a complete line of equipment which can be manufactured and sold without reapplication for further approval on each and every model. The provision of the air space around the heating coil unit in the heart is a particularly desirable feature contributes to a minimum outer surface or skin temperature reducing the amont of insulation required and contributing substantially to safety considerations. The particular arrangement of the shape of the blower chamber, and the location and orientation of the heater unit saves as much as 4 or 5 inches in the length of the heart module as compared with similar conventional units.

What is claimed is:

1. A blower-heater and air conditioning module comprising an inner cabinet having substantially parallel opposite side panels and a curved panel member perpendicular to and connecting said side panels and defining therewith a scroll shaped fan chamber and a connecting rectangular discharge passage, portions of said panel member defining opposite side walls of said discharge passage being substantially parallel to each other and to the axis of rotation of a blower in said fan chamber, said panel member including an integral cutoff portion connecting a portion of said panel member defining said fan chamber with one portion of said panel member defining one side of said discharge passage for restricting the size of said discharge passage, minimizing turbulence in said discharge passage, and for providing substantially linear air flow along said passage; said parallel opposite side panels of said inner cabinet having circular openings therein into said fan chamber; a centrifugal squirrel-cage type blower fan supported in said fan chamber on a motor shaft having an axis of rotation substantially coincident with the centers of said openings in said fan chamber; said motor shaft being on a motor supported in spaced relation from the outside surface of a portion of a first of said side panels of said inner cabinet and spaced from said side panel to permit maximum air flow around said motor into said blower fan through said opening in said first side panel into said fan chamber, said motor and said blower fan being removable from said inner cabinet through said first side panel without removing said panel from said inner cabinet; an electrical resistance heater unit supported in said discharge air passage from a removable portion of said first side panel and located within a rectangular heat shield in the form of a panel member spaced within said discharge air passage from three sides of said discharge air passage to provide a layer of insulation air within said discharge air passage around said heater unit, said heater unit comprising at least one layer of electrical resistance heating coils aligned in a plane substantially perpendicular to a tangent line drawn from said plane to the periphery of said centrifugal blower fan, said heater unit being supported from and removable with said removable portion of the first side panel of said cabinet; all electrical connections and blower motor and heater unit controls for said module being located along both portions of said first side panel of said inner cabinet for service by access to only said first side panel of said inner cabinet; a cube-shaped outer cabinet having first and second opposite side walls spaced from said opposite side panels of said inner cabinet of said module to permit air flow to said side openings in said side panels of said inner cabinet; a third open side wall of said cube-shaped outer cabinet defining a square air intake opening; a square air conditioning coil assembly secured in said air intake opening of said cube-shaped outer cabinet for conditioning air drawn into said cabinet across said coil unit; said coil unit having a condensate drain pan and drain line positioned along one side thereof; means on said outer cabinet permitting said coil unit to be assembled in said cube-shaped outer cabinet at any one of four positions spaced at 90° intervals from each other around said air intake opening of said outer cabinet with said drain pan and drain line properly operatively positioned to receive and drain condensate, said coil unit being generally aligned in a plane perpendicular to said panels of said inner cabinet and parallel with said panel member portions defining said side walls of said discharge flow passage; said cube-shaped outer cabinet having an opening for air discharge coinciding with said air discharge passage of said inner cabinet; and a service access door in said cube-shaped outer cabinet aligned with said first side panel of said inner cabinet for servicing the electrical components of said module from a single side of cube-shaped outer cabinet.

2. Apparatus in accordance with claim 1 wherein said air inlet opening of said cube-shaped outer cabinet is in a side of said cabinet perpendicular to said side of said cabinet in which said air discharge opening is located.

3. Apparatus in accordance with claim 2 wherein said air inlet opening is positioned for horizontal air flow, said air discharge opening is positioned for vertical air flow upwardly, and said access door is adapted to swing open horizontally.

4. Apparatus in accordance with claim 2 wherein said air intake opening is positioned for horizontal air flow, said air discharge opening is positioned for vertical air flow downwardly, and said access door is adapted to swing open horizontally.

5. Apparatus in accordance with claim 2 wherein said air intake opening is positioned for horizontal air flow, said air discharge opening is positioned for horizontal air flow, and said access door is adapted to swing vertically downwardly.

6. Apparatus in accordance with claim 2 including air filter means supported over said air conditioning coil assembly on the up-stream side of said unit for filtering air drawn into said cube-shaped cabinet by said blower fan.

7. A cube fan-coil unit for conditioning air by selectively cooling and heating said air comprising: a cube-shaped cabinet having a first open side defining a square air inlet opening, said cabinet having means for permitting the mounting of a square air conditioning coil unit in said opening in any one of four positions spaced at 90° from each other around said opening, said cabinet having an air discharge opening positioned in a second side of said cabinet perpendicular to said first side of said cabinet; a square air conditioning coil unit secured in said air inlet opening in one of said four positions, said air conditioning coil unit having fluid inlet and outlet connections and a drain pan and line located along a side of said unit; said mounting means permitting said drain pan and drain line of said coil unit to be properly operatively positioned to receive condensate; a heater module secured within said cube-shaped cabinet, said module having opposite side panels positioned parallel to and spaced from third and fourth sides of said cube-shaped cabinet perpendicular to said first side of said cabinet and defining air inlet flow passages down each side of said module communicating with said air inlet opening in said first side of said cube-shaped cabinet, a scroll-shaped panel member secured between said opposite side panels of said module perpendicular to said side panels and defining therewith a blower fan chamber and a rectangular air discharge passage communicating with said chamber and with said air discharge opening in said second side of said cube-shaped cabinet, said side panels of said module having circular air openings communicating with said blower fan chamber, a squirrel-cage type centrifugal blower rotatably positioned in said blower fan chamber on a motor shaft substantially aligned with the centers of said openings in said module side panels, said shaft being supported from a motor secured with and spaced from an outside face of a first of said side panels of said module, an electrical resistance heater unit secured from a portion of said first side panel of said module within said air discharge passage and substantially aligned in a plane perpendicular to a tangent line from said heater unit to the periphery of said blower fan, a substantially rectangular heat baffle around said heater unit spaced within said air discharge passage for providing a flow of cooling air along said air discharge passage around said heater unit to minimize cabinet insulation; electrical connections and control means for said motor and said heater being located along said first panel of said module for servicing said cube unit from only said first side panel of said module; and a service access door in an opening in said cube-shaped cabinet in the side of said cabinet parallel with and adjacent to said first module panel for access to said electrical connections and control means of said module for service and replacement of serviceable parts of said module through only said service door opening.

8. A fan-coil unit ffor conditioning air comprising: a cabinet having a first open side defining a square air inlet opening, said cabinet having means for permitting the mounting of a square air conditioning coil unit in said opening in any one of four positions spaced at 90° intervals from each other around said opening, said cabinet having an air discharge opening positioned in a second side of said cabinet substantially perpendicular to said first side of said cabinet; a square air conditioning coil unit having a condensate drain pan and drain line along one side secured in said air inlet opening in one of said four positions with said drain pan and drain line properly operatively positioned to receive condensate; and a blower module secured within said cabinet, said blower module having an air inlet communicating with said air inlet opening in said first side of said cabinet and an air discharge passage communicating with said air discharge opening in said cabinet.

9. A fan-coil unit for conditioning air in accordance with claim 8 including a heater unit across said discharge passage.

10. A cube fan-coil unit for conditioning air comprising: a cube-shaped cabinet having a first open side defining a square air inlet opening, said cabinet having means for permitting the mounting of a square air conditioning coil unit in said opening in any one of four positions spaced at 90° from each other around said opening, said cabinet having an air discharge opening positioned in a second side of said cabinet perpendicular to said first side of said cabinet; a square air conditioning coil unit having fluid inlet and outlet connections, and said air conditioning coil unit having a drain pan and a drain line located along a side of said unit; said mounting means permitting said drain pan and drain line to be properly operatively positioned to receive condensate; and a blower module secured in said cabinet, said blower module having an air inlet flow passage communication with said air inlet opening in said cabinet and an air discharge passage communicating with said air discharge opening in said cabinet.

11. A cube fan-coil unit in accordance with claim 10 including electrical connections and control means along a first panel of said blower module and a service access door in an opening of said cabinet in a side of said cabinet adjacent to said blower module first panel for service and replacement of servicable parts of said blower module through said opening of said cabinet.

12. A fan-coil unit in accordance with claim 11 including an electrical resistance heater in said discharge passage.

13. A cube fan-coil unit for conditioning air be selectively cooling and heating said air comprising: a cube-shaped cabinet having a first open side defining a square air inlet opening, said cabinet having means for permitting the mounting of a square air conditioning coil unit in any one of four positions spaced at 90° from each other around said opening, said cabinet having an air discharge opening positioned in a second side of said cabinet perpendicular to said first side of said cabinet; a square air conditioning coil unit having fluid inlet and outlet connections and a drain pan and line located along a side of said unit; said mounting means permitting said drain pan and drain line to be properly operatively positioned to receive condensate; a blower-heater module secured within said cube-shaped cabinet, said module having air inlet flow passage means communicating with said air inlet opening in said first side of said cube-shaped cabinet, and an air discharge passage communicating with said air discharge opening in said second side of said cube-shaped cabinet; an electrical resistance heater unit secured within said air discharge passage of said module; electrical connections and control means for said blower module and said heater located along a first panel of said blower-heater module for servicing said unit at only said first panel of said module; and a service access door in an opening in said cube-shaped cabinet in a side of said cabinet adjacent to said first panel of said blower-heater module for access to said electrical connections and control means of said module for service and replacement of serviceable parts of said module through said service door opening.

* * * * *